United States Patent [19]

Hühne

[11] Patent Number: 4,835,022

[45] Date of Patent: May 30, 1989

[54] PROCESS AND APPARATUS FOR COATING COMPONENTS

[75]. Inventor: Erwin D. Hühne, Schallstadt, Fed. Rep. of Germany

[73] Assignee: UTP SchweiBmaterial GmbH & Co. KG, Bundesrpeublik, Fed. Rep. of Germany

[21] Appl. No.: 78,885

[22] Filed: Jul. 29, 1987

[30] Foreign Application Priority Data

Jul. 29, 1986 [DE] Fed. Rep. of Germany ..... 3625659

[51] Int. Cl.[4] ..... B05B 7/20; B05D 1/10

[52] U.S. Cl. ..... 427/423; 427/422; 427/426; 427/196; 239/80; 239/85

[58] Field of Search ..... 427/422, 423, 426, 196, 427/201; 118/311; 239/80, 85

[56] References Cited

U.S. PATENT DOCUMENTS

| | | | |
|---|---|---|---|
| 2,643,955 | 6/1953 | Powers et al. | 427/423 X |
| 3,171,599 | 3/1965 | Rotolico | 239/85 |
| 3,352,492 | 11/1967 | Cape | 239/85 |
| 3,659,151 | 4/1972 | Fabre | 239/298 X |
| 3,912,235 | 10/1975 | Janssen | 259/4 |
| 4,582,254 | 4/1986 | Rotolico et al. | 239/80 |
| 4,634,611 | 1/1987 | Browning | 427/423 |
| 4,696,855 | 9/1987 | Pettit et al. | 427/201 X |

FOREIGN PATENT DOCUMENTS

| | | | |
|---|---|---|---|
| 1212609 | 2/1986 | U.S.S.R. | 239/85 |
| 657300 | 9/1951 | United Kingdom | 427/423 |

*Primary Examiner*—Shrive Beck

*Attorney, Agent, or Firm*—Staas & Halsey

[57] ABSTRACT

The invention relates to a process for the coating of components, wherein a plastic-containing layer is sprayed onto the surface of the components. During spraying, at least one mixture component consisting of a material other than plastic is added directly to a plastic powder. The plastic powder and the mixture component are supplied separately and are separately adjustable.

4 Claims, 4 Drawing Sheets

PROCESS AND APPARATUS FOR COATING COMPONENTS

BACKGROUND OF THE INVENTION

Field of the Invention

The invention relates to a process for the coating of components, wherein by means of a spray technique a plastic-containing layer is deposited onto the surface of the components.

The coating of components of metallic or nonmetallic materials is carried out in particular with a view to long-term corrosion protection, abrasion resistance, service life, etc. By means of plastic layers on components, for example, vessels or pipelines in the chemical industry, it is possible to save expensive materials such as stainless or acid-resistant steels. The components may consist of inexpensive load-bearing materials, while the chemical resistance, the corrosion protection, the abrasion resistance, etc. are achieved by means of the plastic layer. As a rule, the manufacture of heavy-duty plastic layers on a component is carried out by one of three important process techniques: fluidized-bed coating, electrostatic spraying and flame spraying. The fluidized-bed coating, the component, after sand blasting, is heated to the temperature required in each case in a heated furnace and thereafter lowered into the fluidized bed. Upon contact of the component—which has been preheated to the melting point of the plastic—with the powdered plastic, which is fluidized by means of compressed air, the plastic melts and forms a close-packed, smooth and pore-free layer. Mass-produced components with complex surfaces can thus be coated economically. The basic principle of the electrostatic spraying process lies in charging powdered plastic particles electrostatically during the spraying onto the surface of the component, thereby causing them to adhere upon impact and forming a uniform, loose layer. The layer sprayed on in this manner is then fused in an electrically heated furnace. In flame spraying, specially designed spray guns are used, which are usually operated with a combustible-gas-oxygen flame and compressed air. With spray guns one can spray synthetic-type plastics such as, polyesters, polyethylene, epoxides, etc., whereby the sprayed plastic layers so obtained have known technology-related physical as well as chemical properties, which need not be further discussed herein.

Furthermore, West German Pat. No. 3,033,579 discloses a backfire-immune coating device for the application of metallic coating material on metallic support surfaces to be coated. Such a coating device contains a spray gun by means of which, on the one hand, the metal powder and, on the other hand, two combustible-gas components, especially acetylene and oxygen, are supplied to the component.

SUMMARY OF THE INVENTION

An object of the present invention is to provide a process for the fabrication of plastic layers with improved properties, especially wearing behavior. With this process it is possible to make the layers with a high degree of reproducibility, whereby the properties can be predetermined by appropriate choice of material. The layer has a uniform structure, whereby the properties of the layer, both in thickness and throughout the entire surface, are to remain substantially constant. It is possible to carry out the process with a relatively simple apparatus which ensures easy adjustment, controllability, and immunity from sustained back-firing as well as from flame flashback.

To achieve this object, the invention provides that, during coating, at least one mixture component consisting of a material other than plastic be added directly to the plastic powder and that the plastic powder and the mixture component be supplied separately adjustable in the lot.

The process according to the invention permits manufacture of new sprayed-layer grades with specific technology-related physical and chemical properties on the basis of flame spraying of powdered plastic, while mixing-in nonplastic components during the actual coating process. Sprayed layers consisting of a plastic material and a mixture component can be made in any desired mixing ratio, whereby at least two different powdered spray materials can be applied within the scope of this invention. Depending on the mixing ratio, which can be predetermined in accordance with the invention, layers can be made with predetermined properties, whereby a constant layer quality and a high degree of reproducibility of the results can be achieved with minimum investment in equipment and manpower.

According to the plastic-flame-spraying process of the invention, the plastic powder and said at least one powdered mixture component are supplied separately adjustable in the lot during operation by means of a spray gun or the like whereby, during the operation, the mixing process takes place internally within a mixing chamber of the spray gun or externally thereof. The uniformly distributed components, specifically plastic and nonplastic mixture component, are appropriately led by a powder-carrier gas to the spray nozzle and, according to the invention, emerge at the center thereof. There, they are sheathed by an envelope of compressed gas, especially compressed air, which, in accordance with the invention, issues toroidally around the powder hole. The components distributed uniformly in accordance with the invention are sprayed onto the preheated component with the kinetic energy or velocity of the heating flames, which, in accordance with the invention, are disposed in essentially toroidal manner around the stream of compressed gas. The preheating of the component is effected especially by means of the heating flames. As a result of the contact heat, the plastic particles and the particles of the mixture component fuse, or the mixture component is embedded into the plastic matrix distributed uniformly therein. Surprisingly, separation of the plastic material and mixture component during spraying is avoided with assurance, even, and particularly, in the case of a mixture component having a not inconsiderably higher specific gravity than the plastic. Separation, which is unavoidable in the prior art methods, and the irregular inclusion of the mixture component associated therewith are reliably avoided with the process embodying the invention. The flowrate and/or pressure of the compressed gas toroidally surrounding the powder mixture can be preassigned just as the flowrate and/or pressure of the heating gas or of the heating flames which surround the compressed-gas stream radially outwardly in the form of a ring. Depending on the melting point of the plastic employed, the quantities of compressed gas, heating gas and powder mixture or powder-carrier gas are adjusted and regulated. Here, a determining criterion is that the temperature of the compressed gas be preassigned as a function of the melting point of the plastic used in each particular case, whereby, above all, the flowrate and/or pressure of compressed gas and powder-carrier gas are adjusted or regulated in relation to the heating gas being used. As the plastic powder suitable for flame spraying, the following types and grades can be used in particular: Rilson (polyamide-11), Levasint, polypropylene (PP), polyesters, Halar 5003, PVDF, Volvosan, polyethylene, epoxides and hardeners. Preferred mixture components include the following additives; carbides, such as fused tungsten carbides, chromium carbides; also metal powders, especially iron-based powders, chromium-nickel steel, copper and copper alloys, titanium, light metals, molybdenum, nickel as well as chromium and similar metals. Furthermore, borides, especially chromium borides, molybdenum borides or the like and also silicides, electrocorundum and epoxides with hardener can be used as mixture components. With the process incorporating the invention, binary mixtures of epoxide resin and hardener can be also processed without problems. An important criterion for the process in accordance with the invention is the mixing of plastic powder with one or more mixture components during the coating process, either directly inside or outside the spray gun.

The apparatus for carrying out the process includes at least two independently adjustable delivery systems, namely, one for the plastic powder and said at least one additional mixture component. The apparatus further includes a spray gun, which has at least two connections for the supply of the mixture component which is mixed in a mixing chamber inside the spray gun. Alternatively, the spray gun may have only one entry fitting for the powder supply, and the plastic powder and said at least one additional mixture component are mixed externally in a two- or multi-way connection. Furthermore, the spray gun may additionally have one or more internal powder-delivery systems, from which additional mixture component is led into the mixing chamber of the system. In another embodiment, the spray gun is provided with an attachable powder-metering unit, in order to bring into the heating flame, by means of the hourglass principle, at least one other mixture component, especially coarse-grained tungsten carbide or electrocorundum, and the powder emerging from the spray nozzle. In terms of delivery capacity, all the components or delivery systems can be separately controlled in accordance with the particular type of powder. The spray gun in accordance with the invention has a spray nozzle with a central powder bore. There is also provided a nozzle arrangement coaxially surrounding the powder hole and especially in the form of an annular duct in order to predetermine the pressure or the flowrate of the compressed gas for the cooling of the spray nozzle and/or the temperature as a function of the melting point of the plastic being used, and it is also important that the outlet bores or the like for the heating flames be toroidally disposed around this nozzle arrangement. The powder mixture, the toroidally emerging compressed gas and the heating flames each issue substantially axially from the spray gun. In particular, compressed air, which toroidally surrounds the powder mixture and which is sprayed onto the component with the kinetic energy or in accordance with the velocity of the heating flames arranged toroidally around the stream of compressed air, is used as the compressed gas. The flowrate of the compressed gas or of the compressed air is adjusted or regulated, just like the other components. Here, the temperature of the compressed gas can be adapted without difficulty to the particular requirements, whereby the requirements conveniently result as a function of the melting point of the plastic being used.

BRIEF DESCRIPTION OF THE DRAWINGS

The invention will now be discussed in greater detail by reference to the practical embodiments shown in the accompanying drawing, in which.

DETAILED DESCRIPTION OF THE PREFERRED EMBODIMENTS

Figure 1:
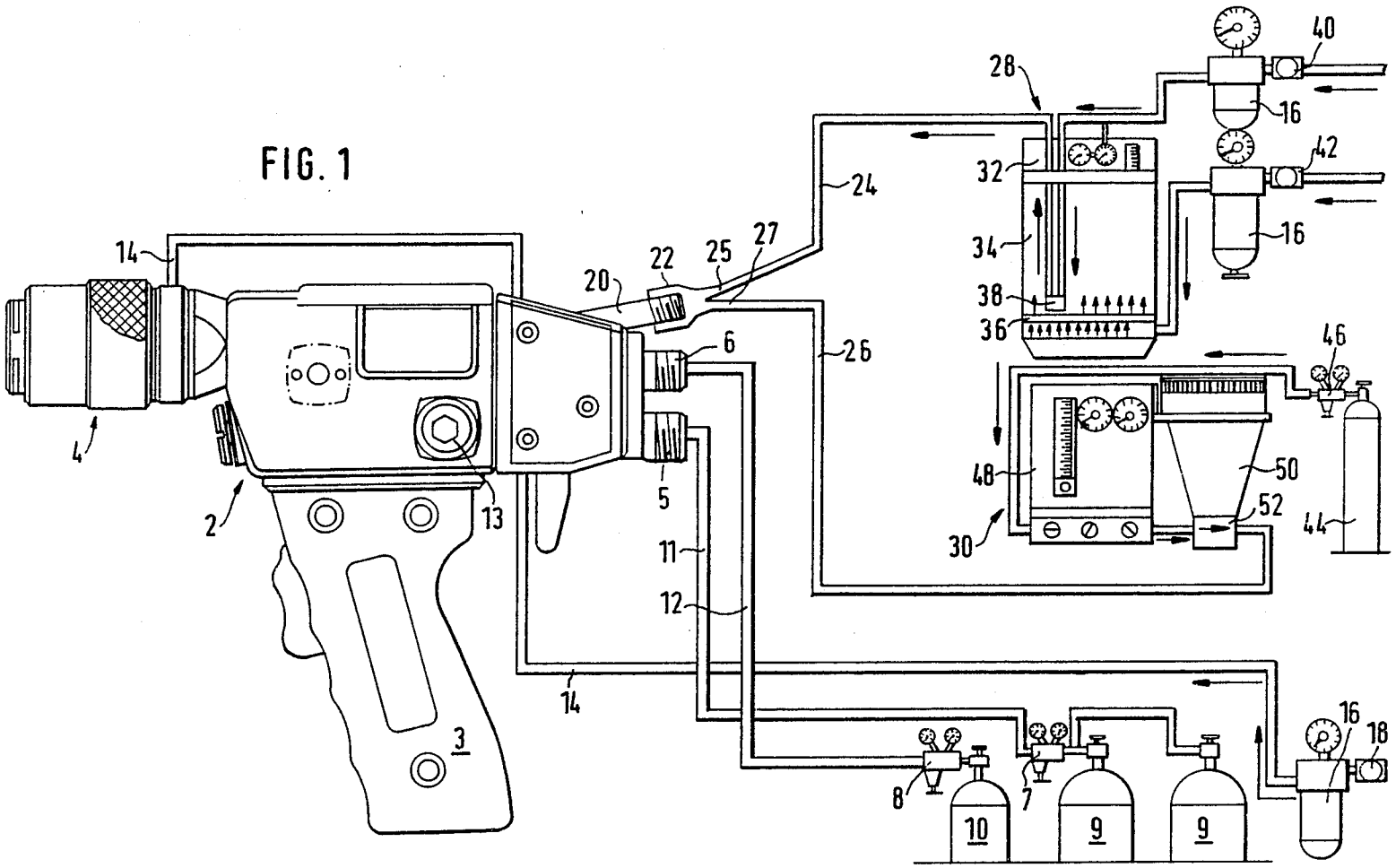
FIG. 1 is a schematic diagram of an apparatus with external powder mixing representing a first preferred embodiment of the present invention.

FIG. 1 shows a spray gun 2 with a handle 3, a burner head 4 as well as connections 5, 6 for combustible gas and heating oxygen, respectively. The pressure and flowrate of the combustible gas and oxygen can be preassigned in the usual manner by means of regulators 7, 8, whereby the oxygen and the combustible gas, i.e., acetylene or propane or hydrogen, can be supplied from, respectively, cylinders 9, 10 via flexible tubes or lines 11, 12. The spray gun 2 contains a regulating and shut-off valve 13 for the combustible gas and the oxygen being supplied.

Compressed gas, especially compressed air, is also supplied to the spray gun 2 via a line 14. The compressed gas, which is adjusted by an upstream regulator 18, is purified by means of a moisture-and-oil separator 16. The compressed gas supplied via the line 14 forms an envelope, as will be further explained in the following section, around the powder mixture emerging centrally from the spray nozzle or the burner head 4.

The spray gun 2 contains a common connection 20, at which a two-way piece 22 is connected. At the two-way piece 22 are connected a line 24 with a connection 25, through which line plastic powder is supplied, and a line 26 with a connection 27 for a mixture component. A first delivery system 28 is provided for the plastic powder and a second delivery system 30 for the mixture component. The first delivery system 28 contains a regulating-and-control device 32 disposed on top of a container 34 for the plastic powder. A powder-delivery pump 38 projects into the container 34, which has a fluidized-bed bottom 36. Compressed gas, particularly compressed air, is supplied to both the regulating-and-control device 32 and the container 34, whereby again the compressed air can be adjusted via moisture-and-oil separator 16 and regulating valves 40, 42. The second delivery system 30 is fed from a cylinder 44 with nitrogen or argon via a regulator 46. There is also provided a control unit 48 with a powder conveyor, downstream of which is connected a powder container 50 for the mixture component, such as, for example, metal or ceramic powder. The mixture component is passed via the powder-delivery system 52 and the line 26 to the two-way piece 22 mentioned above. The plastic powder and the mixture component can be adjusted to the delivery systems 28, 30 mentioned above, independently of each other.

Figure 2:
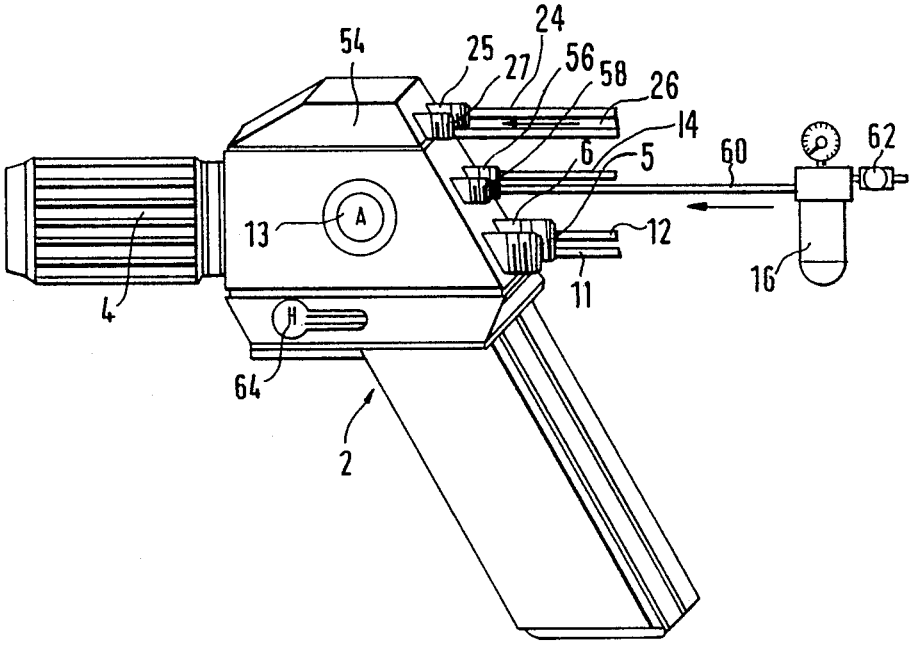
FIG. 2 is a schematic diagram of a spray gun with internal powder mixing representing a second preferred embodiment of the present invention.

FIG. 2 shows an embodiment in which the plastic powder and the mixture component are blended inside the spray gun 2. The spray gun 2 contains a connecting head 54, to which are separately connected the line 24 for the plastic powder and the line 26 for the mixture component. The supply of combustible gas, oxygen and compressed gas is again effected via the lines 11, 12 and 14. For the sake of simplicity, the delivery systems and regulators, etc. are not shown herein. Here, the compressed gas for cooling the spray nozzle is supplied not directly to the burner head, but to the connection 56 of the spray gun 2. The spray gun also contains another connection 58 for a line 60, through which a separate powder-carrier gas, particularly compressed air, is supplied. This powder-carrier-gas is passed internally via a pressure nozzle into the mixing chamber located, according to the invention, in the spray gun in order to spray the mixture of plastic powder and mixture component to the burner head 4 and from the powder hole thereof onto the component to be coated. In accordance with the invention, the powder-carrier gas is adjusted by means of a regulator 62. The spray gun embodying the invention also contains a master shut-off valve 64 for combustible gas, oxygen as well as internal and external powder-carrier gas.

Figure 3:
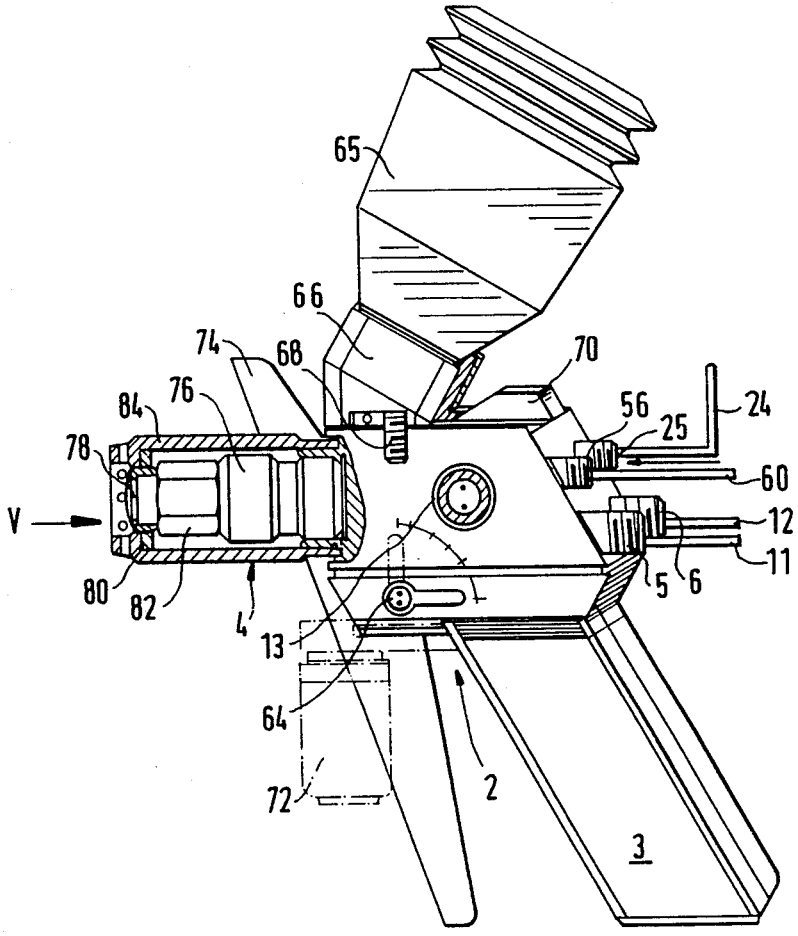
FIG. 3 shows diagrammatically a spray gun with integrated powder delivery system representing a third preferred embodiment of the present invention.

FIG. 3 shows an important embodiment in which the mixture component is contained in a powder container 65, which is disposed by means of a modular connecting head 66 on top of the spray gun 2. At the connecting head 66 is located a powder-shut-off lever 68, and the modular connecting head 66 is locked with a bolt 70. If necessary, an electromagnetic vibrator 72 can also be placed on the spray gun 2. Finally, a heat shield 74 is also disposed in the front region of the spray gun 2.

The burner head 4 contains a connecting adapter 76 for a gas-mixing plastic spray nozzle 78. There are also shown a dummy ring 80 as well as a nozzle-pressure bolt 82 and, finally, a surrounding cap-screw sleeve nut 84, by means of which the fastening to the spray gun 2 is effected manually.

Figure 4:
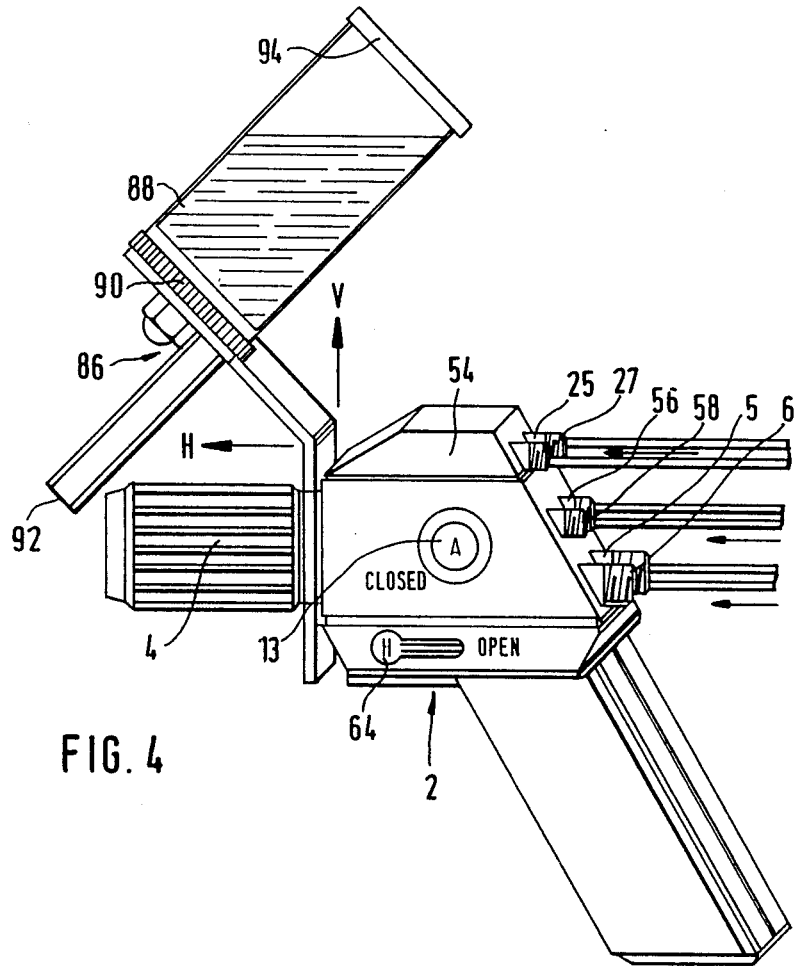
FIG. 4 shows diagrammatically a spray gun representing a fourth preferred embodiment of the present invention in which a mix component can be supplied by the hourglass principle.

FIG. 4 shows an embodiment which basically corresponds to that of FIG. 2, but here only the expedients additional thereto will be discussed. Between the burner head 4 and the spray gun 2 there is connected a metering unit 86 with a powder container 88. In the powder container 88 of the powder-metering unit 86, another mixture component, such as, for example, coarse-grained tungsten carbide or electrocorundum can be introduced by the hour-glass principle into the heating flame and the powder emerging from the spray nozzle or the burner head 4. At the bottom of the container 88 there is located a metering and shut-off valve plate 90 according to whose position the powder can be introduced via the inlet tube 92 by the hourglass principle. The container 88 has in its upper portion a cover 94 for refilling with powder. The unit 86 can be adjusted horizontally or vertically, in the direction of the arrows H or V, relative to the spray gun 2 and thereby to the burner head 4.

Figure 5:
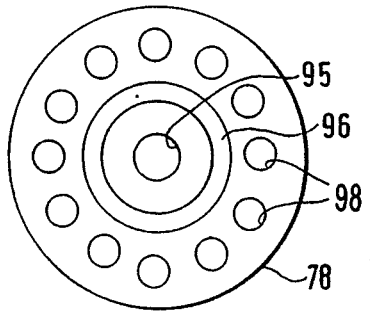
FIG. 5 shows diagrammatically a view of the spray nozzle in the viewing direction V shown in FIG. 3.

FIG. 5 is a diagrammatical view of the burner head in the viewing direction V shown in FIG. 3. Of the spray nozzle 78 is clearly shown the central powder hole 95, which is surrounded, at a radial distance, by a coaxial nozzle arrangement 96. Here, this nozzle arrangement 96 is formed as an annular duct. The compressed gas for cooling the spray nozzle and for preassigning the temperature emerges through the nozzle arrangement 96. Finally, a number of radially outwardly extending bores 98 for the heating flame visible. The spray nozzle is cooled on account of the nozzle arrangement 96 and the supply of compressed gas. Depending on the melting point of the plastic being used, one regulates in the manner taught by the invention—by controlling the flowrate of the compressed gas between the powder mixture and carrier gas emerging from the central powder hole 95 and the heating flames arranged toroidally on the outside—the temperature of the gas or air stream emerging axially therebetween from the annular nozzle arrangement 96.

What is claimed is:

1. A process for coating a component, comprising the steps of:

depositing a plastic-containing layer including a plastic powder onto the surface of a component using a spray technique;

adding at least one mixture component directly to the plastic powder prior to said depositing step, the mixture component being a powder and consisting of a material other than plastic, the supplies of the plastic-containing powder and the mixture component being separately adjustable;

toroidally enveloping the powder mixture with a toroidal stream of compressed gas; and surrounding the toroidal stream with annularly disposed heating flames.

2. The process as recited in claim 1, wherein the non-plastic powder has a higher specific gravity than the plastic powder.

3. The process as recited in claim 1 or 2, further comprising the step of continuously mixing the plastic-containing powder and the mixture component inside a mixing chamber of a spray gun.

4. The process as recited in claim 1 further comprising, transforming the powder mixture of plastic and mixture component to a hot-melt plastic state by the toroidally surrounding compressed gas stream, the compressed gas being compressed air having a flowrate preassigned as a function of the melting point of the plastic powder use, the sprayed powder mixture and the toroidally surrounding heating flame being adjusted independently of each other, the plastic being protected during spraying by the compressed gas.

* * * * *